US006305821B1

(12) United States Patent
Hsieh et al.

(10) Patent No.: US 6,305,821 B1
(45) Date of Patent: Oct. 23, 2001

(54) LED LAMP HAVING BALL-SHAPED LIGHT DIFFUSING MODIFIER

(75) Inventors: Yuan-Tai Hsieh, Tainan Hsien; Jui-Sheng Lin, Tainan, both of (TW)

(73) Assignee: Gen-Home Technology Co., Ltd., Tainan Hsien (TW)

( * ) Notice: Subject to any disclaimer, the term of this patent is extended or adjusted under 35 U.S.C. 154(b) by 0 days.

(21) Appl. No.: 09/500,033

(22) Filed: Feb. 8, 2000

(51) Int. Cl.[7] ..... F21V 5/00

(52) U.S. Cl. ..... 362/246; 362/237; 362/240; 362/244; 362/555; 362/582

(58) Field of Search ..... 362/800, 227, 362/235, 237, 244, 246, 240, 276, 806, 811, 310, 311, 363, 551, 555, 558, 559, 570, 571, 565; 359/599, 615, 462, 664, 707; 385/901

(56) References Cited

U.S. PATENT DOCUMENTS 4,097,917 * 6/1978 McCaslin ..... 362/565
4,211,955 * 7/1980 Ray ..... 315/53
4,727,457 * 2/1988 Thillays ..... 362/582
4,847,734 * 7/1989 Katoh et al. ..... 362/555
4,901,207 * 2/1990 Sato et al. ..... 362/555
5,032,960 * 7/1991 Katoh ..... 362/240
5,140,220 * 8/1992 Hasegawa ..... 313/512
5,311,417 * 5/1994 Heh ..... 362/397
5,775,800 * 7/1998 Hsieh ..... 362/295

* cited by examiner

*Primary Examiner*—Sandra O'Shea
*Assistant Examiner*—Ismael Negron
(74) *Attorney, Agent, or Firm*—Rosenberg, Klein & Lee

(57) ABSTRACT

LED lamps include a hollow light-transparent ball and one or more LED of the same or different colors fixed behind the ball, which has an inner semi-transparent layer and an outer transparent layer. The semi-transparent layer has a larger deflecting percentage than the outer transparent layer so that light emitted by the LED may deflect and collide with each other many times in the semi-transparent layer of the ball to produce soft and evenly mixed colored light when seen through the ball.

26 Claims, 9 Drawing Sheets

LED LAMP HAVING BALL-SHAPED LIGHT DIFFUSING MODIFIER

BACKGROUND OF THE INVENTION

This invention relates to LED lamps, particularly to ones applicable to decorative lamps, display lamps, a unit of an LED screen, traffic lights, car lamps or night lamps.

Conventional LED lamps are widely used, having a large variety for many different uses.

SUMMARY OF THE INVENTION

This invention has been devised to offer a kind of LED lamp made of a hollow light-transparent ball with one or more LED of the same or different colors fixed at rear side of the ball. The ball has an outer transparent layer and an inner semi-transparent layer having a deflecting percentage larger than the outer layer. Then one or more LED emit light, and the light is deflected and collide with one another inside the semi-transparent layer to give out soft mixed evenly colored light through the outer transparent layer.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
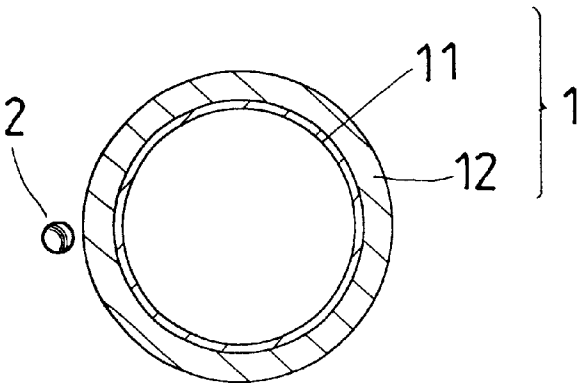
FIG. 1 is a cross-sectional view of a ball and an LED of the present invention.

A preferred embodiment of LED lamps in the present invention, as shown in FIG. 1, includes a hollow spherical ball 1, and one or more LED 2 of the same or different colors fixed at a rear side of the ball 1. The ball 1 has an inner semi-transparent layer 11 and an outer transparent layer 12 having less deflecting percentage than the inner semi-transparent layer 11. When one or more LED emit light, the light may be deflected and collided with each other many times inside the ball 1, giving out soft and evenly mixed colored light through the outer transparent layer 12.

Figure 3:
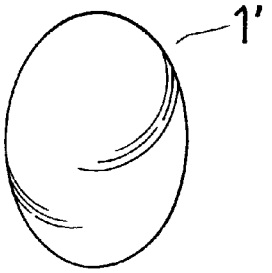
FIG. 3 is a perspective view of an oval ball of the present invention.
Figure 2:
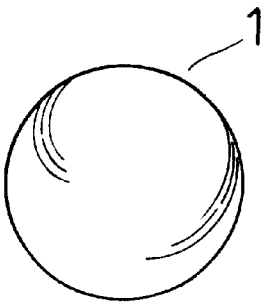
FIG. 2 is a perspective view of a spherical ball of the present invention.

Next, referring to FIGS. 2 and 3, the ball 1, 1' can be a hollow spherical shape or a hollow oval shape, and the spherical one has a better light mixing effect.

The ball 1, 1' can be formed by injecting and shooing process, and a decorative matter may be contained therein for decoration.

Figure 4:
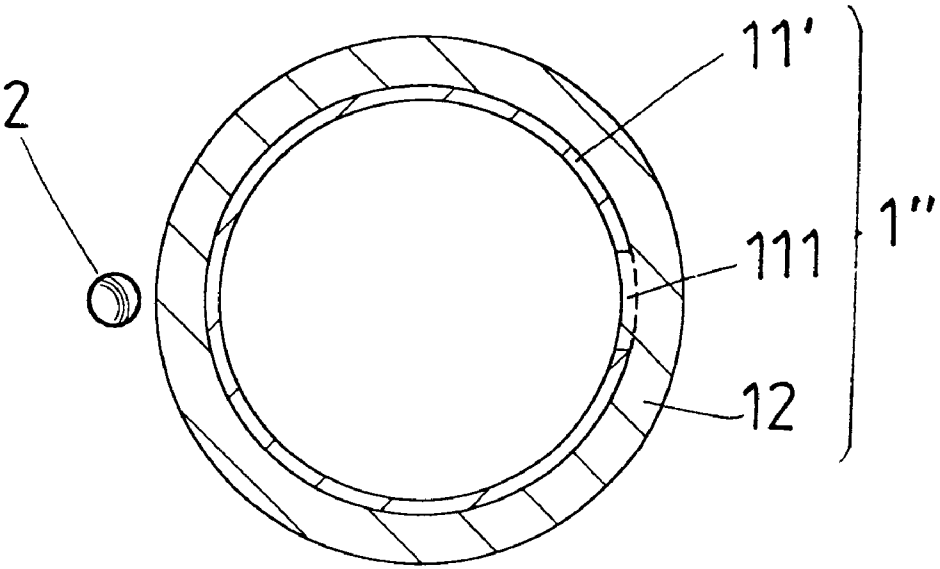
FIG. 4 is a cross-sectional view of a spherical ball with a semi-transparent layer having a front transparent section of the present invention.

The semi-transparent layer 11 my be plated on an inner side of the outer transparent layer 12, a sand ground surface or a corroded surface on the inner side of the outer layer. The semi-transparent layer may be formed with letters, words or patterns, and additionally, as shown in FIG. 4, the semi-transparent layer 11' of the ball 1" has a transparent section 111 in a front side to increase luminance.

Figure 5:
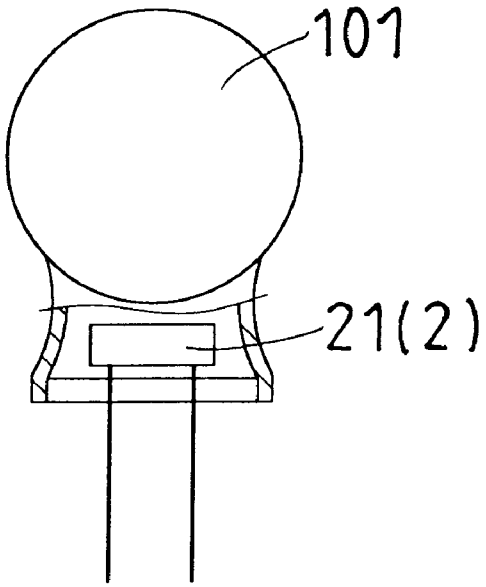
FIG. 5 is a front view of the spherical ball assembled with an LED as integral of the present invention.

In fact, a common LED is made of a dice enveloped with an outer clear transparent layer, so called "water clear" by makers, and two conductive pins extending out from two sides of the dice to function as a negative and a positive pole to be powered. FIG. 5 shows a ball 1 combined with an LED as integral, with the ball 1 fixed with a transparent side of the LED and one or more dice 21 with two conductive pins extending out.

Figure 7:
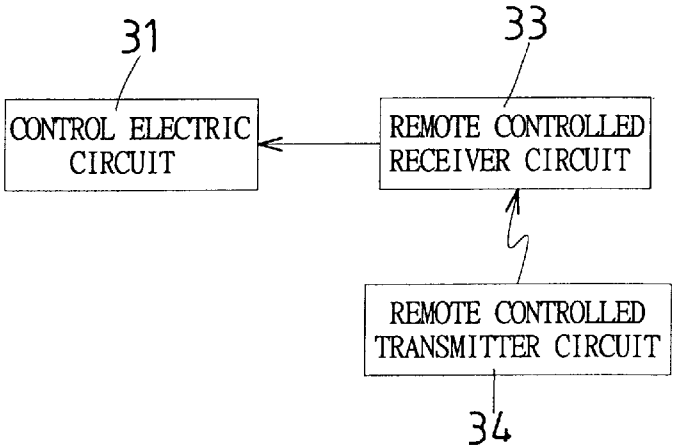
FIG. 7 is a block diagram of a control circuit combined with a remote control receiver circuit and a remote control transmitter circuit of the present invention.
Figure 6:
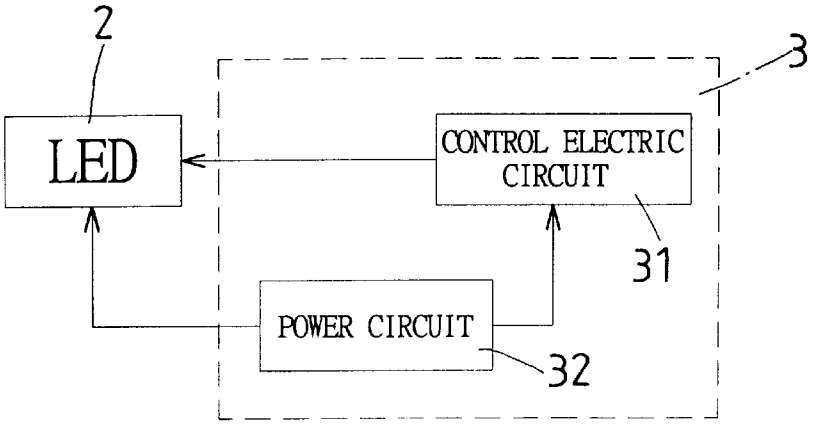
FIG. 6 is a block diagram of a basic electric circuit of the present invention.

FIG. 6 shows that the LED 2 described above is controlled by a circuit 3 consisting of a control electric circuit 31 and a power circuit 32, letting one or more LED 2 lit, flash and mixing lights. The control circuit may be controlled by a program to let one or more LED lit up or flash with various modes to be selected to use. The LED preferably have red, green and blue colors separately to produce mixed light expected in advance. FIG. 7 shows that the control circuit 31 is also connected to a remote controlled receiver circuit 33 so as to be combined with a remote control transmitter circuit 34 so that the LED are controlled remotely to be lit up or flash, The remote controlled receiver circuit 33 and the transmitter circuit 34 can be operated with wireless frequency or infrared ray.

Figure 8:
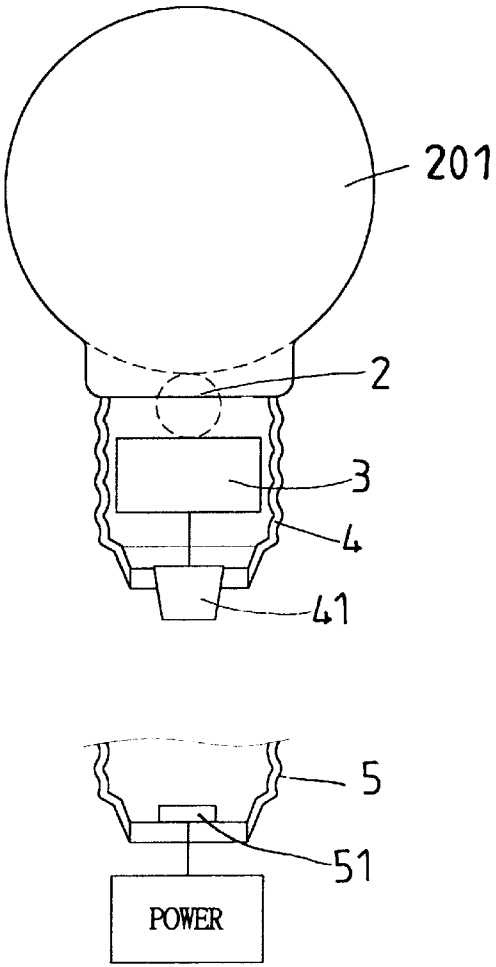
FIG. 8 is a front view of the ball, the LED and a conductive screw socket assembled together of the present invention.

Next, FIG. 8 shows that the ball 201 and an LED 2 can be combined integral, and a conductive screw cylinder 4 fixed with one end of the LED. The conductive screw cylinder 4 has a conductor 41 at the center of the bottom and a circuit consisting of a control electric circuit 31 and a power circuit 32 contained in the interior, with two power terminals respectively connected to the cylinder 4 and the conductor 41. A screw socket 5 is provided to screw with the screw cylinder 4, having a conductor 51 on the center of its bottom to supply power to the circuit 3.

Figure 9:
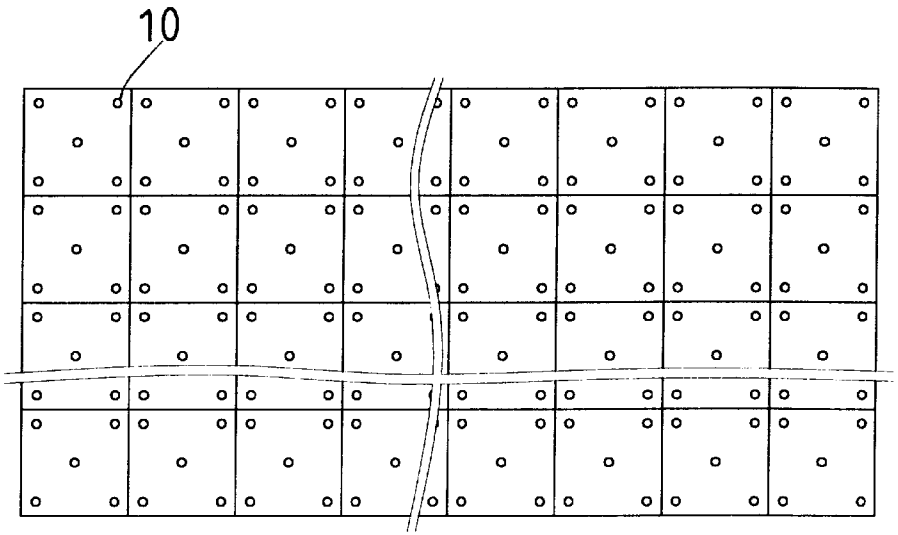
FIG. 9 is a front view of an LED screen composed of the LED units of the present invention.
Figure 10:
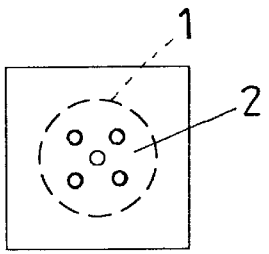
FIG. 10 is a front view of a unit LED of the present invention.

The LED lamp can also be applied to an LED screen, and as shown in FIG. 9. Common LED screens are composed of a plurality of unit LED arranged in rows and files and each unit has a plurality of scattered LED 10, and the scattered LED 10 seem to be only a light point when seen from a high distant place, So those light points can make up letters, words or patterns on the LED screen. But when it is seen at a near place, the luminance of the LED may be too strong, and the scattered LED 10 may not seem as one light point. On the contrary, as shown in FIG. 10, a unit LED of an LED screen in the invention is composed of a ball 1 and plural LED, which give out light to be seen through the ball 1 as only one point of soft mixed light. Thus, the LED screen can show letters, words, patterns whether seen from a far place or a near place.

Figure 11:
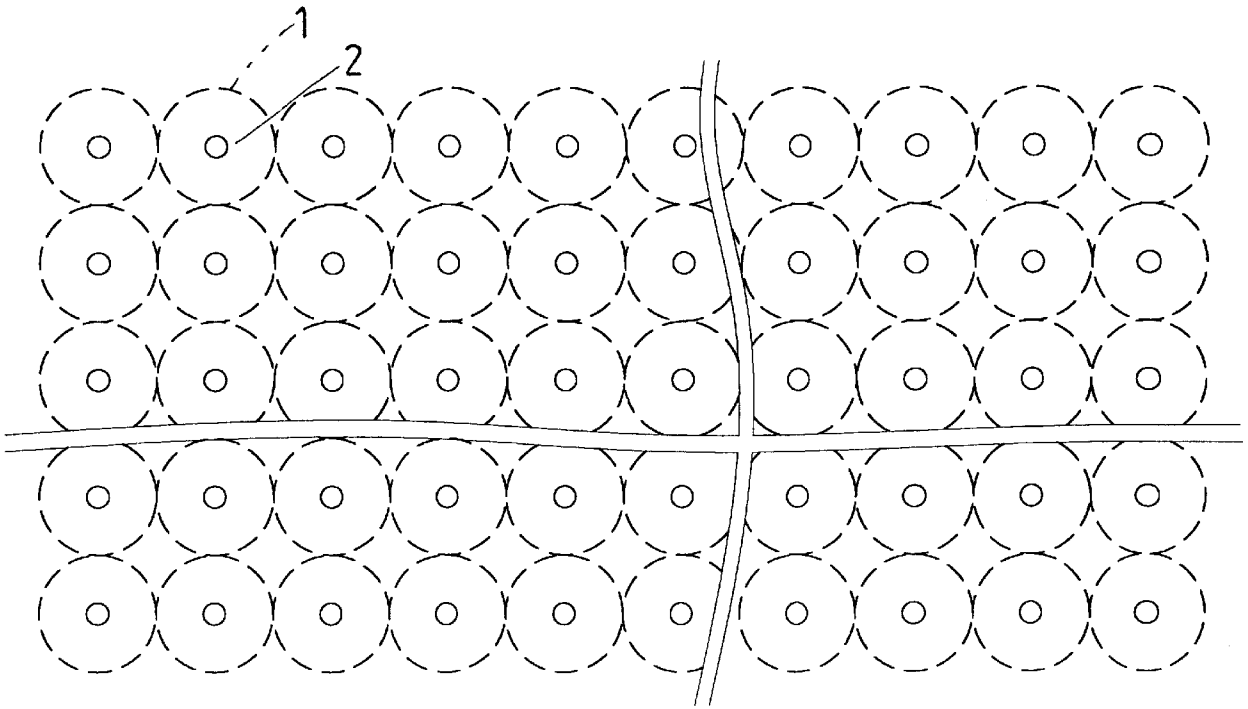
FIG. 11 is a front view of LED lamps arranged in rows and files of the present invention.

Next, as shown in FIGS. 6 and 11, an LED lamp group composed of a plurality of the balls 1 with LED 2 are arranged in a rectangular shape, and controlled with the programmed control circuit 31 to properly let the LED lamps lit up or flash or turned off in such a way to show letters, words or patterns.

Figure 12:
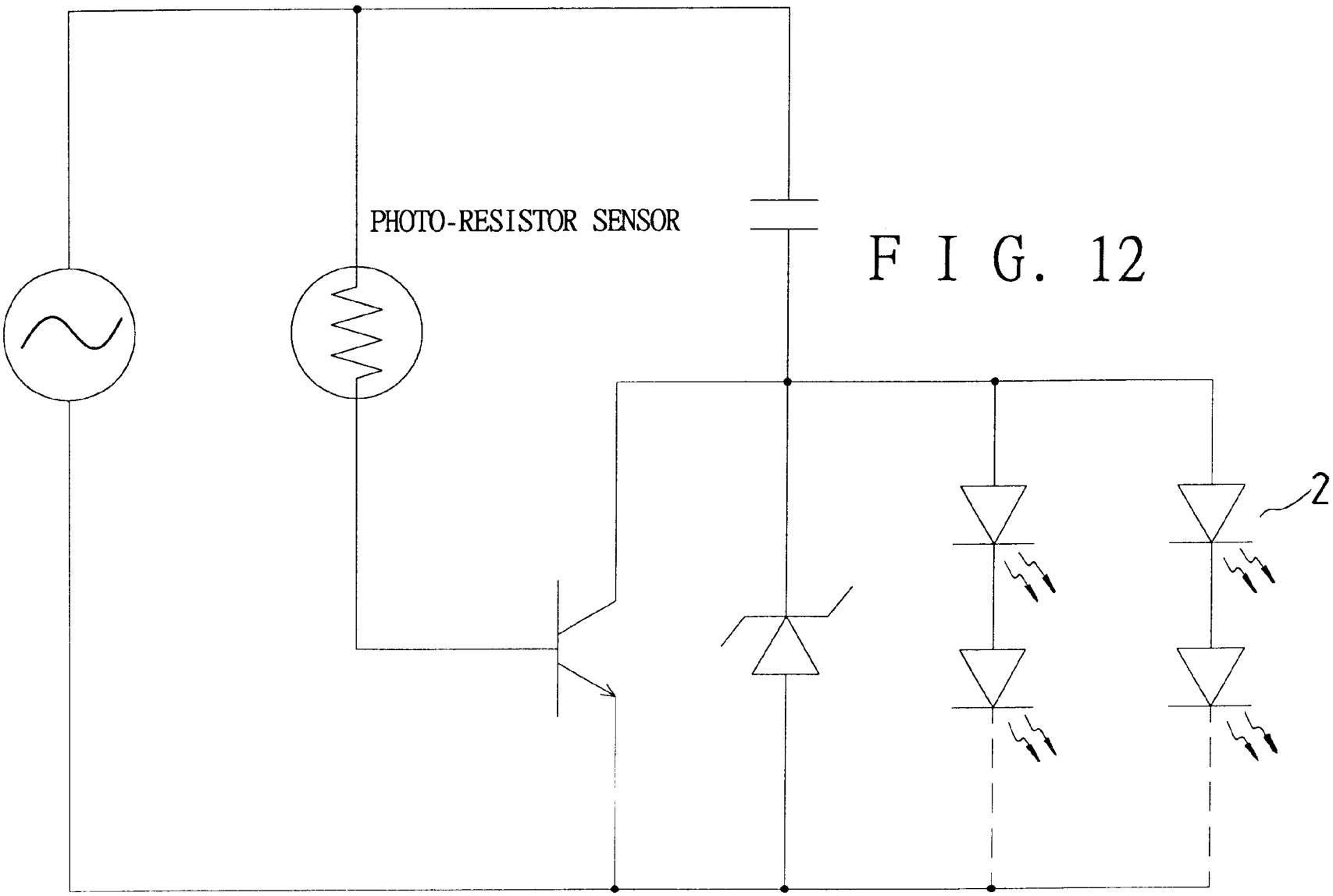
FIG. 12 is a preferred circuit for a night lamp of the present invention.

The lamp groups just described can also be used as a traffic light or car lights, and its Luminance can depend on the total number of LED lit up. Further, the LED lamps in the invention can also be utilized as night lamps, controlled with a preferred electric circuit shown in FIG. 12. A photo-resistor sensor is used in the circuit in cooperation with other components, permitting this LED night lamp is lit up automatically when it is dark enough.

Figure 14:
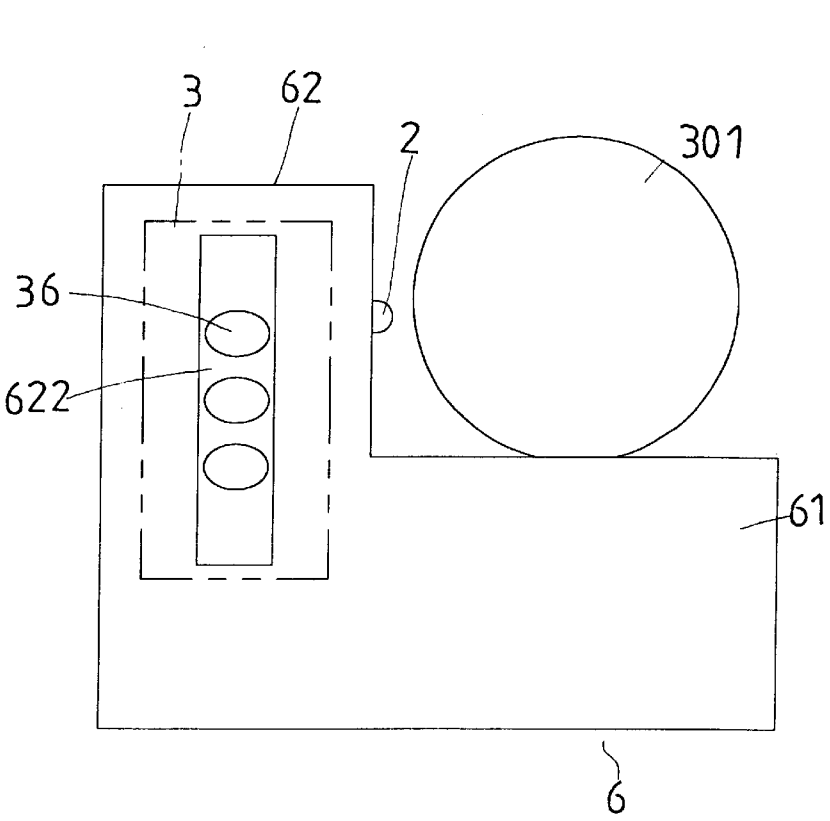
FIG. 14 is a side view of the display lamp of the present invention.
Figure 13:
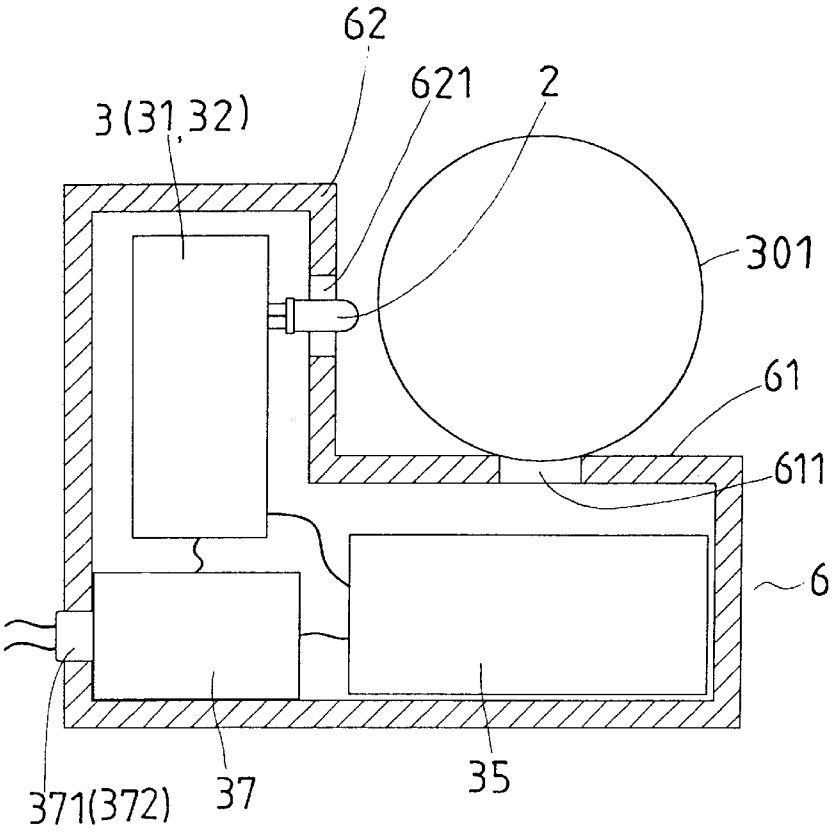
FIG. 13 is a side cross-sectional view of a display lamp of the present invention.
Figure 15:
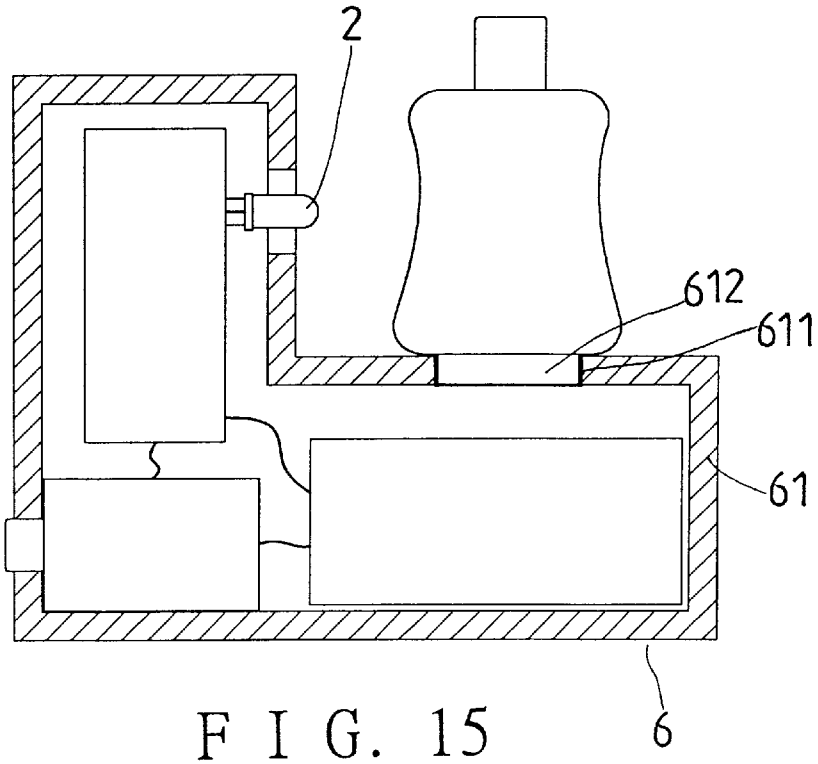
FIG. 15 is a side cross-sectional view of the display lamp placed with a displayed object of the present invention.

Next, the LED lamp in the invention can also be used as a display lamp as shown in FIGS. 13 and 14, with the ball 301 deposited on the socket 61 of a base 6. And the base 6 further have an extension base 62 extending from the vertical side of the socket 61 for containing a battery 35 and the circuit 3 consisting of a control electric circuit 31 and a power circuit 32 to control the LED 2 to turn on or off, The extension base 62 has a hole in a right side wall for an LED controlled by the circuit 3 to protrude out, and the hole is just located behind the ball 301, In addition, the object to be displayed is placed in front of the ball 301, shooting out soft mixed evenly colored light on the displayed object. Further, as shown in FIG. 15, the ball 301 is taken off the socket 61, and the hole 611 *s* closed up with a cap 612 and then the displayed object is put on the socket 61, then still LED may shine on the displayed thing.

In the LED lamp shown in FIGS. 13 and 14, the extension base 62 of the base 6 has elongate holes 621, 622 respectively in an inner side and another side for an LED 2 connected to the circuit 3 and operating keys to protrude out. The position of the circuit 3 can be adjusted up or down so as to let the LED 2 located at a better point to shine on the ball 301 if the ball 301 has a different shape or size.

Figure 16:
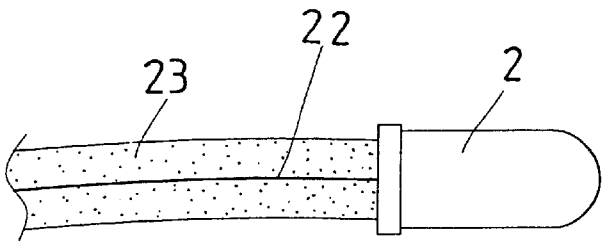
FIG. 16 is a side view of an LED connected to a lead and a flexible bar of the present invention.

Or as shown in FIG. 16, the LED 2 may be connected to a lead 22 connected to the circuit 3, and then the lead 22 is surrounded with an insulating and flexible material 23 to let the lead 22 bend by means of the flexible material 23 to adjust the location of the LED to shine on the ball 1 from a better point.

Next, as shown in FIG. 13, an additional electric circuit 37 can be provided in the base 6, having a plug hole 371 and a power plug hole 372 protruding out of the base 6. Then the lead of another display LED lamp can be connected with the plug hole 371 to use two display LED lamps in parallel, with the power plug hole 372 for the lead of the power to connect to.

Figure 17:
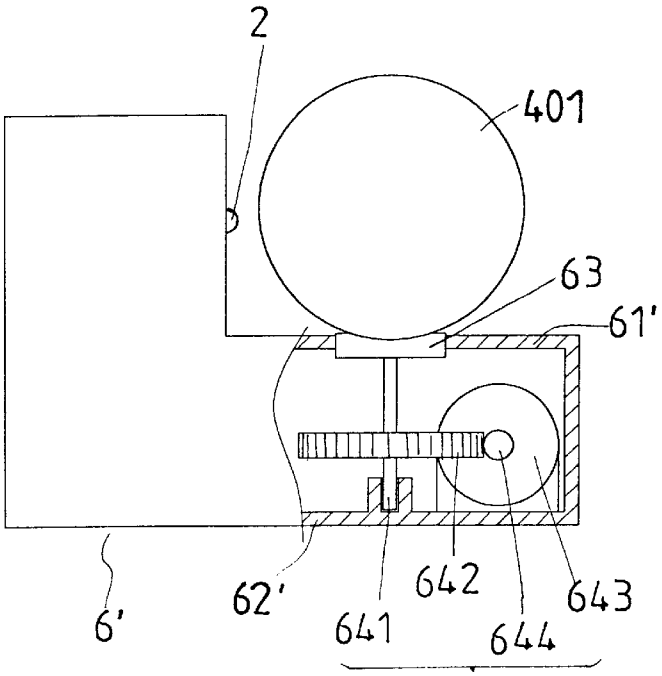
FIG. 17 is a side cross-sectional view of the LED lamp combined on rotatable disc of the present invention.

In addition, as shown in FIG. 17, the socket 61' of the base 6' may be combined with a rotatable disc 63 rotated by a rotating deice 64 contained in the extension base 62'. The rotating device 64 consists of a worm gear 642 fixed with a lower end of a shaft 641 of the disc 63 and engaging with a worm 644 fixed with he spindle of a motor 643. Then a ball 401 or an object to be displayed is placed on the disc 6', which can then be rotated together with the ball 401 *o* the displayed object; with light of the LED shining on them to attract curiosity of lookers.

Figure 18:
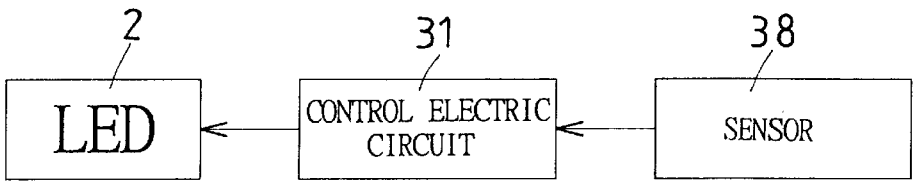
FIG. 18 is a block diagram of the LED lamp connected to a sensor of the present invention.

Besides, a sensor 38 may be connected to the control electric circuit 31, as shown in FIG. 18, permitting the control circuit 31 automatically make dimmer the luminance of the LED 2 when the sensor 38 senses someone coming near the LED display lamp. Then the LED may not be so bright to irritate the eyes of lookers. The sensor 38 may be a pair of an infrared receiver and a transmitter so that the control circuit 31 may calculate the distance of a person coming to adjust the luminance of the LED, when infrared ray emitted by the transmitter is collided with the person and reflected and received by the receiver. In other words, the nearer the person is, the darker the LED becomes. The sensor can be also a heat infrared sensor to command the control circuit 31 to automatically make darker the LED 2 if it senses someone approaching, The LED lamps in the invention have the following advantages.

1. The luminance of the LED 2 becomes softer and evenly mixed after shot out of the ball 1.
2. The ball 1 can contain a decorative matter for decoration.
3. The semi-transparent layer 11 of the ball 1 can be formed with letters, words, or patterns as decoration or business advertisement.
4. The ball 1 and the LED 2 can be formed integral, used as a comparatively small electronic component.
5. The LED can be turned on or off in a wide variety of ways by means of a programmed control circuit.
6. The control circuit 31 can be remotely controlled.
7. If an LED screen is composed of a plurality of a unit LED of the invention, the LED screen may be looked at from a near place without irritating eyes of lookers, as each unit LED gives out soft and evenly mixed light so that letters, words, or patterns shown on the LED screen may seem very soft and delicate.
8. When a plurality of the LED lamps in the invention are arranged in rectangular shape and controlled by a programmed control circuit 3 they can form letters, words or patterns by lit up or gone out.
9. It can be utilized as traffic lights, car lights or night lamps.
10. A base can be used for displaying lamps to shine a displayed object with soft and evenly mixed colored light. An additional inset hole may be formed in the base for a plug of a lead of another lamp to insert to use two lamps in parallel and controlled synchronously. Besides, a rotatable disc 63 may be fixed on the base to let the ball 401 or the displayed object rotated in conjunction with light of LED so as to make a vividly impressive display lamp. In addition, a sensor 38 may be connected with the control circuit 31 to automatically let luminance of the LED a little darker to prevent eyes of lookers from being irritated when the sensor senses someone approaching.

What is claimed is:

1. LED lamps comprising a hollow light-penetrating ball and one or more LED of the same or different colors fixed behind said ball, said ball having an inner semi-transparent layer and an outer transparent layer, said semi-transparent layer having a larger deflecting percentage than said outer transparent layer, light emitted by said one or more LED and deflected and colliding with each other inside said semi-transparent layer many times so that light seen through said ball may look comparatively soft and evenly mixed.

2. The LED lamps as claimed in claim 1, wherein said ball is a hollow spherical one.

3. The LED lamps as claimed in claim 1, wherein said ball is a hollow oval one.

4. The LED lamps as claimed in claim 1, wherein said ball is formed by means of injecting shooting process, containing a decorative matter.

5. The LED lamps as claimed in claim 1, wherein said semi-transparent layer inside said transparent layer of said ball is plated with a semi-transparent material.

6. The LED lamps as claimed in claim 1, wherein said semi-transparent layer is a sand ground surface on the inner side of said outer transparent layer.

7. The LED lamps as claimed in claim 1, wherein said semi-transparent layer is an eroded surface made on an inner side of said outer-transparent layer.

8. The LED lamps as claimed in claim 1, wherein said semi-transparent layer has a transparent section formed in a front side to increase projecting luminance.

9. The LED lamps as claimed in claim 1, wherein said ball and said LED are assembled together as integral, with said ball fixed on a transparent side of said LED and one or more dice fixed on the other side, said dice having two conductive pins extending out from two sides thereof.

10. The LED lamps as claimed in claim 1, wherein said LED preferably have some colored green, red or blue so as to produce any color expected after mixing with each other.

11. The LED lamps as claimed in claim 1, wherein said LED is controlled by a circuit consisting of a control electric circuit and a power circuit letting one or some LED to lit up or lash.

12. The LED lamps as claimed in claim 11, wherein said LED preferably have some colored green, red and blue so as to produce any color expected after mixing with each other.

13. The LED lamps as claimed in claim 11, wherein a programmed control electric circuit is provided to preset to turn on or off or flash said LED in various ways to select.

14. The LED lamps as claimed in claim 11, wherein a remote controlled receiver circuit is connected to said control electric circuit and a remote controlled transmitter to remote control lighting or flashing of said LED.

15. The LED lamps as claimed in claim 1, wherein said ball and said LED assembled integral, a conductive screw cylinder fixed at one end of said LED, a conductor fixed insulated on a center of a bottom of said cylinder, a circuit consisting of a control electric circuit and a power circuit contained in said screw cylinder, two terminals of the power respectively connected to said conductive screw cylinder and said conductor.

16. The LED lamps as claimed in claim 15, wherein a conductive screw socket is screwed with said conductive screw cylinder, a conductor fixed insulated on a bottom of said conductive screw socket to contact with said conductor of said screw cylinder, said conductive screw socket and said conductor connected to power to turn on and off said LED.

17. The LED lamps as claimed in claim 1, wherein a display unit of an LED screen is composed of said ball and plural said LED located in a concentrated condition, light emitted by plural said LED looking like only one point soft and evenly mixed when seen through said ball.

18. The LED lamps claimed in claim 1, wherein said LED lamp is used as a night lamp.

19. The LED lamps claimed in claim 1, wherein said LED lamp is used in a display lamp; said ball placed on a socket of a base, said socket having a hole for said ball to sit therein stably, an extension base extending from a vertical side of said base, a circuit consisting of a control electric circuit and a power circuit for turning on and off or flashing said LED lamps, said extension base having a hole in an inner wall for an LED controlled by the circuit to protrude out said hole located behind said ball, an object to be displayed put in front of said ball to shine on said object with soft and evenly mixed colored light.

20. The LED lamps as claimed in claim 19, wherein said ball is a hollow spherical one.

21. The LED lamps as claimed in claim 19, wherein said ball is a hollow oval one.

22. The LED lamps as claimed in claim 19, wherein said semi-transparent layer of said ball is plated on an inner side of said outer transparent layer with a semi-transparent material.

23. The LED lamps as claimed in claim 19 said semi-transparent layer of said ball is a sand ground surface on an inner side of said outer transparent layer.

24. The LED lamps as claimed in claim 19, wherein said semi-transparent layer of said ball is a corroded surface on an inner side of said transparent layer.

25. The LED lamps as claimed in claim 19, wherein said semi-transparent layer of the ball has a transparent section formed in a front side.

26. The LED lamps as claimed in claim 19, wherein said LED preferably have some colored green, red and blue so as to produce any colors after mixing with each other.

* * * * *